US006412633B1

(12) United States Patent
Costa

(10) Patent No.: US 6,412,633 B1
(45) Date of Patent: Jul. 2, 2002

(54) ANTI-THEFT CONTAINER FOR COMMERCIAL ITEMS

(76) Inventor: Emilio Costa, Viale Trento 81/B, 36078 Valdagno (IT)

( * ) Notice: Subject to any disclaimer, the term of this patent is extended or adjusted under 35 U.S.C. 154(b) by 0 days.

(21) Appl. No.: 09/656,864

(22) Filed: Sep. 7, 2000

(30) Foreign Application Priority Data

Sep. 21, 1999 (IT) ..... PD99A0206

(51) Int. Cl.[7] ..... B65D 81/00

(52) U.S. Cl. ..... 206/459.5; 206/1.5; 206/807; 220/326

(58) Field of Search ..... 206/1.5, 459.1, 206/528, 540, 807, 459.5; 220/315, 324, 326; 340/541, 571; 70/63

(56) References Cited

U.S. PATENT DOCUMENTS 4,688,023 A * 8/1987 McGill et al. ..... 206/1.5
4,847,597 A * 7/1989 Dobosi et al. ..... 206/807
5,153,561 A * 10/1992 Johnson ..... 340/571
5,164,706 A * 11/1992 Chen ..... 340/571
5,377,510 A 1/1995 Smith
5,510,768 A * 4/1996 Mann ..... 340/571
5,646,592 A * 7/1997 Tuttle ..... 340/541
5,791,079 A 8/1998 Mazzucchelli
6,239,712 B1 * 5/2001 Hawk ..... 206/807

FOREIGN PATENT DOCUMENTS

| | | |
|---|---|---|
| DE | 35 22 252 | 1/1987 |
| FR | 2 729 490 | 7/1996 |
| GB | 2 150 207 | 6/1985 |

* cited by examiner

*Primary Examiner*—Jim Foster
(74) *Attorney, Agent, or Firm*—Guido Modiano; Albert Josif; Daniel O'Byrne

(57) ABSTRACT

An anti-theft container, comprising two half-box-like components wherebetween the item to be protected is enclosed. A first one of the components has an enclosure containing an excitable signaling component and an engagement means in which one end of a tab which protrudes from a second one of the components is insertable and lockable.

19 Claims, 4 Drawing Sheets

ANTI-THEFT CONTAINER FOR COMMERCIAL ITEMS

BACKGROUND OF THE INVENTION

The present invention relates to an anti-theft container for commercial items.

The container is particularly but not exclusively suitable for valuable items packaged in boxes and/or bottles (perfumes, cosmetic products. cigarettes, crystal items, caviar, videocassettes, etcetera).

It is known that anti-theft devices provided with a component suitable to be detected if immersed in an electromagnetic field, usually generated at a guided exit from a shop or other commercial establishment in which such anti-theft devices are adopted, are now increasingly widespread.

These devices are rigidly coupled to the item to be protected against theft and are separated therefrom by breaking or by removal by means of special tools, usually when the item is regularly purchased.

Current anti-theft devices comprise a strap which is suitable to close in a noose-like fashion around an application portion of the item to be protected against theft.

The strap is provided with a container for a device which is excitable and therefore detectable in the presence of electromagnetic fields.

These devices are inherently unsuitable to protect objects such as those mentioned above, which have no region that can be surrounded in a noose-like fashion.

SUMMARY OF THE INVENTION

The aim of the present invention is to provide an anti-theft device which is structurally capable of being applied so as to protect items packaged in a box, or a bottle, or the like.

Within the scope of this aim, a consequent primary object is to provide a device which can be disengaged from the item to which it is applied without having to break the device proper.

Another object is to provide a device which still allows to view the item to which it is applied.

Another object is to provide a device which can be marketed at competitive prices.

These and other objects which will become better apparent hereinafter are achieved by an anti-theft container, characterized in that it comprises two half-box-like components wherebetween an item to be protected is enclosed, a first one of said components having an enclosure containing an excitable electronic signaling component and an engagement means in which one end of a tab which protrudes from a second one of said components is insertable and lockable.

BRIEF DESCRIPTION OF THE DRAWINGS

Further characteristics and advantages of the present invention will become better apparent from the description of a preferred but not exclusive embodiment of the device, illustrated only by way of non-limitative example in the accompanying drawings, wherein.

DESCRIPTION OF THE PREFERRED EMBODIMENTS

Figure 2:
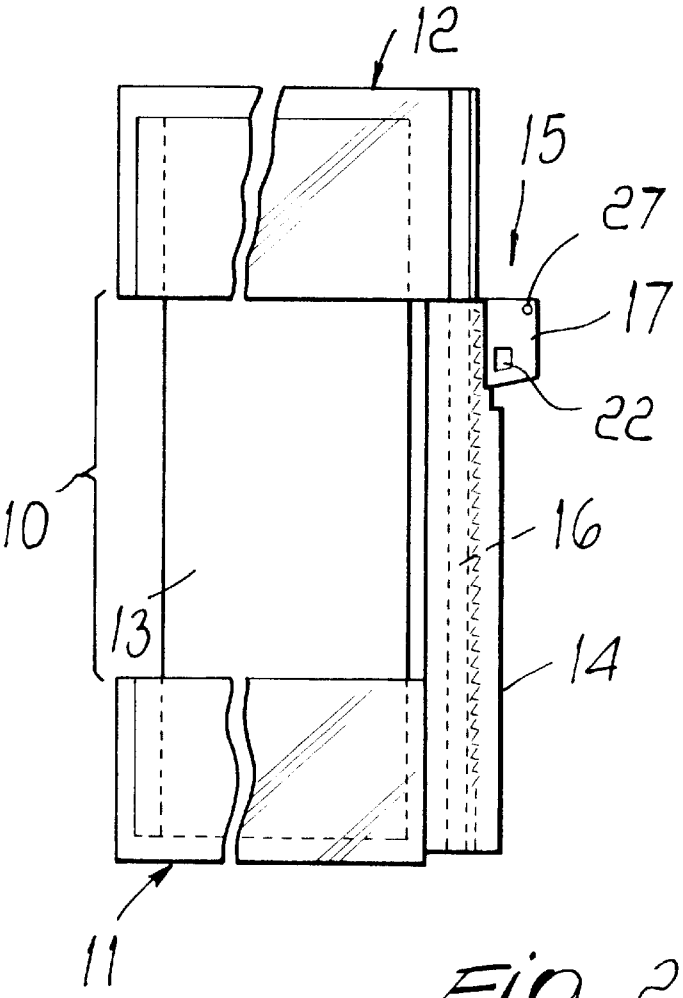
FIG. 2 is a side view of the container of FIG. 1.
Figure 1:
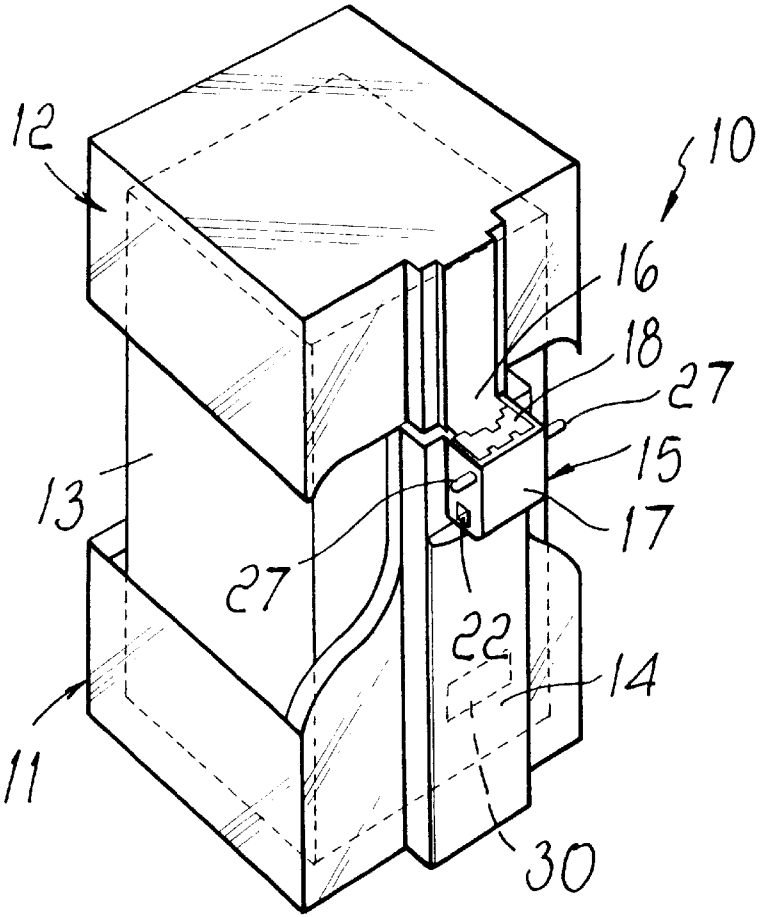
FIG. 1 is a perspective view of an anti-theft container according to the invention during use.
Figure 4:
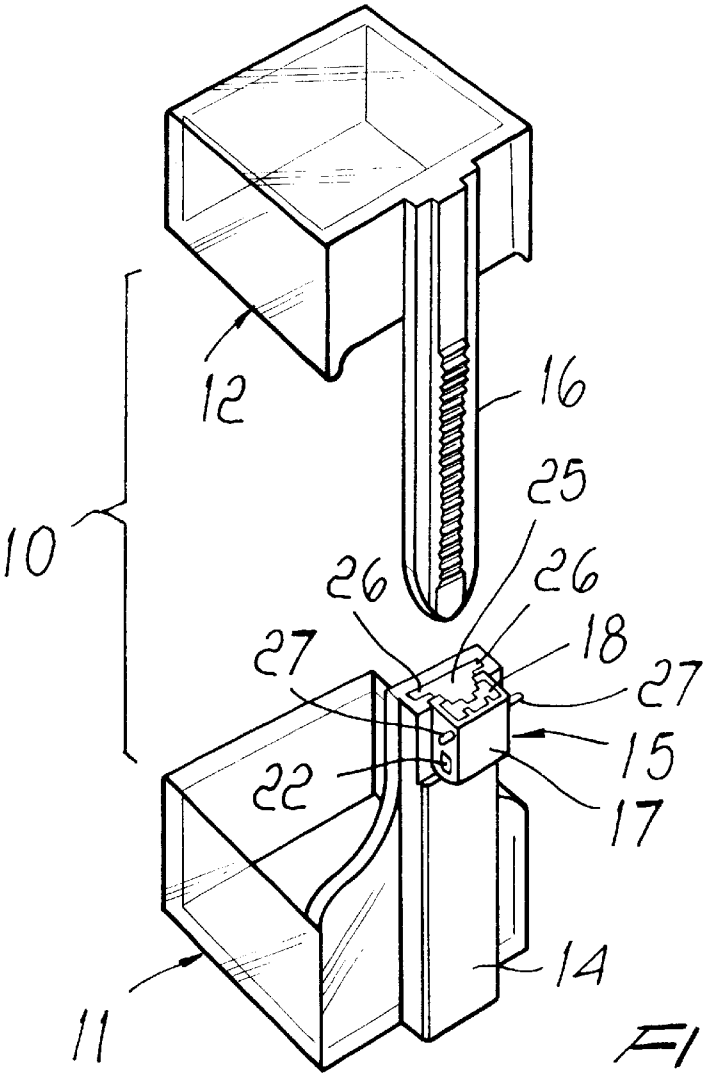
FIG. 4 is a perspective view of the container of FIG. 1, shown with its components in a disassembled configuration.
Figure 3:
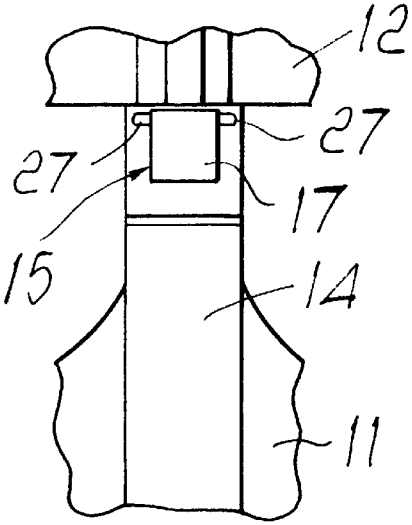
FIG. 3 is an enlarged-scale view of a detail of the container of FIG. 1.
Figure 6:
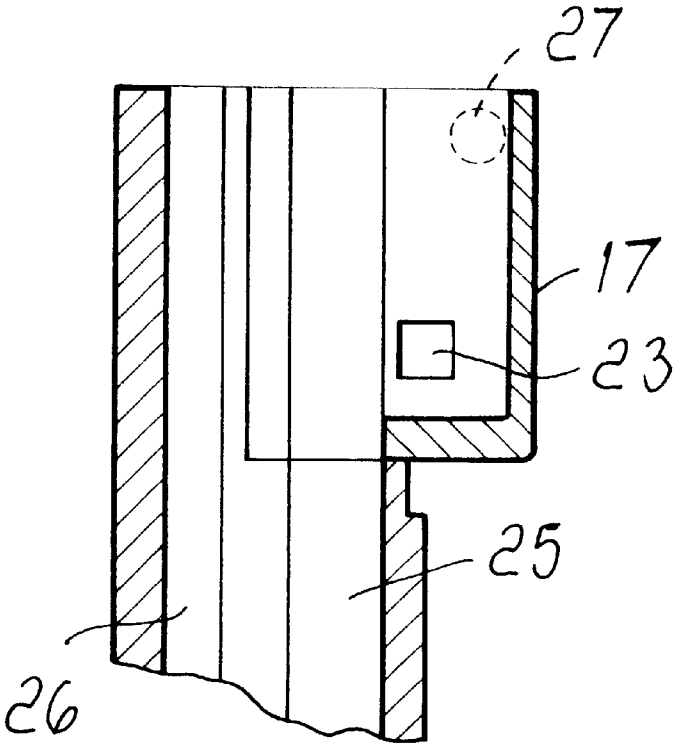
FIG. 6 is a sectional view of a portion of an engagement means which is provided in a first component of the container, for a tab with a toothed rack which protrudes from a second component.

With reference to FIGS. 1 to 8, an anti-theft container according to the invention is generally designated by the reference numeral 10 and comprises two half-box-like components, respectively a first one 11 and a second one 12, between which an item 13 to be protected is enclosed.

The two components, in this case, have a parallelepipedal contour which matches the parallelepipedal shape of the object 13 and are conveniently made of transparent plastics in order to avoid concealing the item 13.

The first component 11 is externally provided, on one face, with an enclosure 14 which contains an excitable electronic signaling component 30 which is known per se and commercially available, and with an engagement means 15 for the insertion and locking of a tab 16 which protrudes correspondingly from the second component 12.

The tab 16 is rack-shaped, with teeth having a triangular cross-section, and is rigidly coupled to the second component 12.

The device 10 is fastened by inserting the tab 16 in the engagement means 15.

The engagement means 15 is constituted by a box-like body 17 rigidly coupled to the first component 11 and by a component 18 which can be inserted therein and is provided with a central elastic arm 19 which is monolithic with respect to a base 20 provided with parallel facing elastic wings 21 (see FIGS. 7 and 8); each wing has, at its end, an engagement tooth 22 which is directed outward and is designed to be inserted stably, on assembly, in a corresponding through hole 23 formed in a corresponding wall of the box-like body 17; the slope of the arm 19 is perpendicular to the slope of the wings 21.

The component 18 also has, at the arm 19, a portion 24 which is rack-shaped and is suitable to couple to the tab 16, with respect to which it is shaped complementarily.

Moreover, the box-like body 17 is combined with a tubular guide 25, with respect to which it lies at one end and in which the internal surface is shaped so as to form two mutually opposite slots 26 for the guided insertion of the tab 16, which is shaped complementarily thereto in a transverse direction.

The enclosure 14 is arranged on the guide 25.

Disengagement of the tab 16 is possible only by using dedicated pliers, not shown in the figure.

The pliers are arranged correctly by way of mutually opposite pins 27 which are externally provided on the box-like body 17 and acts, by means of a tab, so as to flex the arm 19, moving it away from the tab 16 and disengaging the sets of teeth.

In practice, in order to protect against theft the item 13 by means of the container 10, such item 13 is inserted between the components 11 and 12 and the tab 16 is inserted in the engagement means 15 as far as possible.

The mutual engagement of the sets of teeth prevents the opening of the container 10 and therefore prevents the disengagement of the signaling device provided in the enclosure 14.

Any passage of the item 13 through the electronically controlled entrance of the commercial establishment causes the intervention of the alarm signaling system.

During sale, the item can be released by the seller by means of the pliers and therefore the buyer can pass with it through the electronically controlled access without causing the alarm to intervene.

It has been observed that the present invention has achieved the intended aim and objects.

The main feature is the possibility to apply the anti-theft device to a plurality of different items which can be contained between its half-box-like components.

The maximum limit is in fact determined by the length of the tab 16 and by the breadth and contour of the plan surface of the two components.

Figure 5:
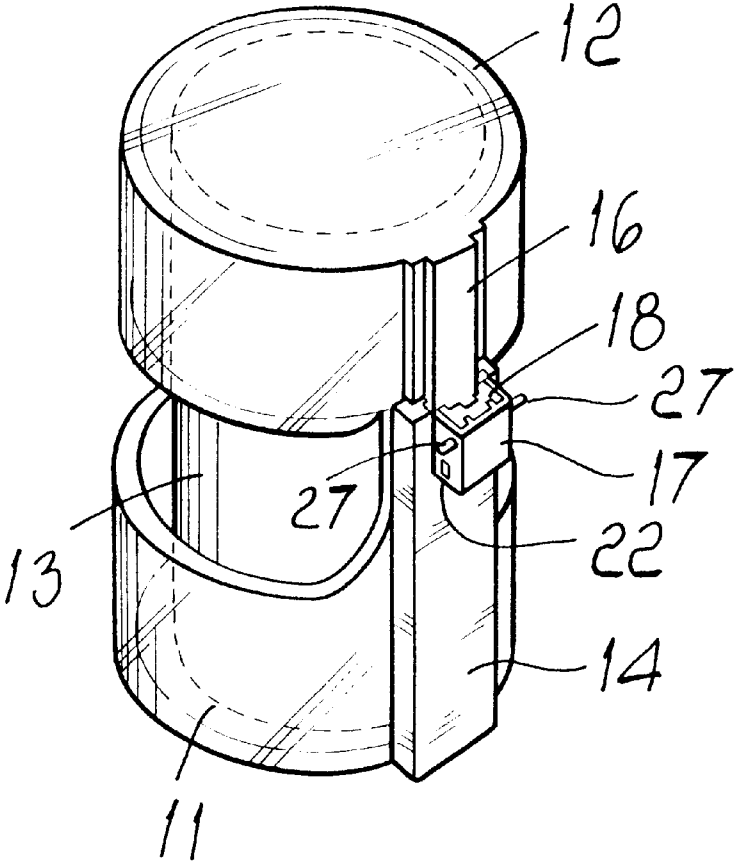
FIG. 5 is a perspective view of a second embodiment of the container.
Figure 8:
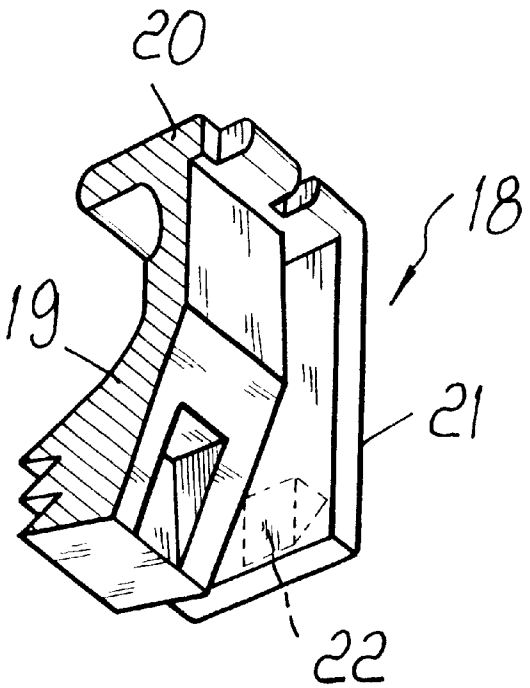
FIG. 8 is a perspective view of another part of the engagement means of FIG. 6.
Figure 7:
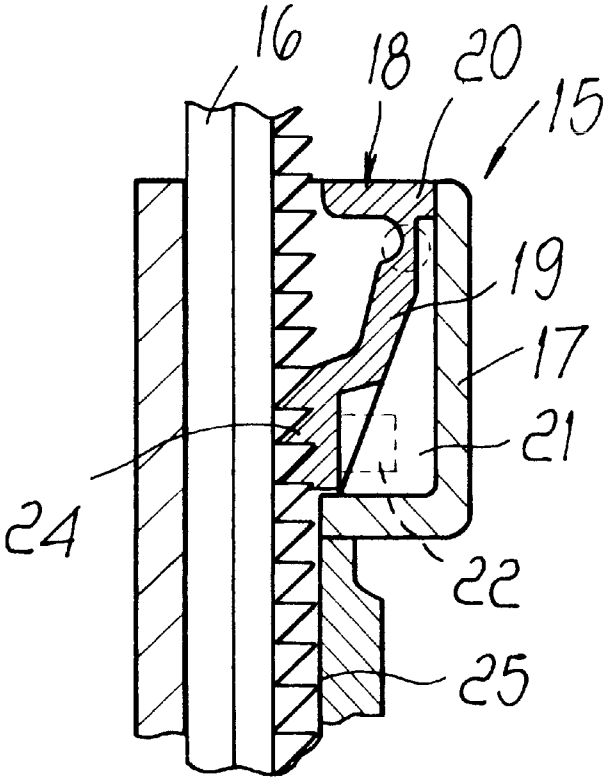
FIG. 7 is a sectional view of the engagement means in the assembled configuration, in which the tab provided with a toothed rack is inserted.

Other plan shapes, for example the circular one shown in FIG. 5, can in fact be convenient in many cases.

Attention is drawn to the structural simplicity of the device according to the invention, which can be effectively mass-produced and marketed at particularly competitive prices.

Attention is also drawn to the fact that the device according to the invention does not hinder at all the buyer's possibility to evaluate and handle the item to which it is applied.

The materials, so long as they are compatible with the contingent use, as well as the dimensions, may be any according to requirements.

The disclosures in Italian Patent Application No. PD99A000206 from which this application claims priority are incorporated herein by reference.

What is claimed is:

1. An anti-theft container, comprising two box-like components which are adapted in a first configuration of the two box-like components to selectively releasably enclose an item to be protected such that the item is not removable from the container to protect the item from theft, and which are adapted in a second configuration of the two box-like components to permit the item to be removed from the container, a first one of said components having an enclosure which contains an excitable electronic signaling component adapted to be detected in an electromagnetic field of a controlled passage to cause an intervention of an alarm signaling system, and an engagement means in which one end of a tab which protrudes from a second one of said components is insertable and lockable.

2. The anti-theft container according to claim 1, wherein said components are adapted to be mutually moved relative to one another between said first and second configurations in a linear direction.

3. The anti-theft container of claim 2, wherein said linear direction is parallel to a longitudinal extension direction of said tab.

4. The anti-theft container of claim 1, wherein said two components are mutually completely separated from one another in said second configuration.

5. The anti-theft container of claim 1, wherein said two components have internal contours which match external contours of the item to be protected.

6. The anti-theft container of claim 1, wherein said two components have internal contours which match respective external contours of oppositely arranged extremities of the item to be protected.

7. The anti-theft container of claim 1, wherein said two components have internal parallelepipedal contours.

8. The anti-theft container of claim 1, wherein said two components are made of transparent plastics for avoiding concealment of the item to be protected.

9. The anti-theft container according to claim 1, wherein said components are adapted to be mutually moved relative to one another between said first and second configurations in a linear direction, and wherein said two components are mutually completely separated from one another in said second configuration.

10. The anti-theft container of claim 9, wherein said linear direction is parallel to a longitudinal extension direction of said tab.

11. The anti-theft container of claim 1, wherein said two components have internal contours which match external contours of the item to be protected, and wherein said two components are made of transparent plastics for avoiding concealment of the item to be protected.

12. The anti-theft container of claim 1, wherein said two components have internal contours which match respective external contours of oppositely arranged extremities of the item to be protected, and wherein said two components are made of transparent plastics for avoiding concealment of the item to be protected.

13. The anti-theft container according to claim 1, wherein said components are adapted to be mutually moved relative to one another between said first and second configurations in a linear direction, and wherein said two components are mutually completely separated from one another in said second configuration, and wherein said two components have internal contours which match external contours of the item to be protected, and wherein said two components are made of transparent plastics for avoiding concealment of the item to be protected.

14. The anti-theft container according to claim 1, wherein said components are adapted to be mutually moved relative to one another between said first and second configurations in a linear direction, and wherein said two components are mutually completely separated from one another in said second configuration, and wherein said two components have internal contours which match respective external contours of oppositely arranged extremities of the item to be protected, and wherein said two components are made of transparent plastics for avoiding concealment of the item to be protected.

15. An anti-theft container, comprising two half-box-like components wherebetween an item to be protected is enclosed, a first one of said components having an enclosure which contains an excitable electronic signaling component and an engagement means in which one end of a tab which protrudes from a second one of said components is insertable and lockable, said tab being shaped like a rack with triangular teeth.

16. An anti-theft container, comprising two half-box-like components wherebetween an item to be protected is enclosed, a first one of said components having an enclosure which contains an excitable electronic signaling component and an engagement means in which one end of a tab which protrudes from a second one of said components is insertable and lockable, said engagement means being constituted by a box-like body and by a component which is insertable therein and being provided with a central elastic arm which is monolithic with respect to a base provided with parallel and mutually facing elastic wings, each wing having, at an end thereof, an engagement tooth which is directed outward and is to be stably inserted, on assembly, in a corresponding through hole formed in a corresponding wall of the box-like body, said arm having a direction of slope perpendicular to a direction of the slope of said wings.

17. The container according to claim 16, wherein said elastic arm is shaped complementarily to the rack of said tab and protrudes in a same direction, producing a permanent locking effect.

18. An anti-theft container, comprising two half-box-like components wherebetween an item to be protected is enclosed, a first one of said components having an enclosure which contains an excitable electronic signaling component and an engagement means in which one end of a tab which protrudes from a second one of said components is insertable and lockable, said box-like body being combined with a tubular guide whose internal surface is shaped so as to form two mutually opposite slots for a guided insertion of said tab, which is shaped complementarily thereto.

19. The anti-theft container according to claim 18, wherein said enclosure with the electronic signaling component is arranged on said tubular guide.

* * * * *